US009839259B2

(12) United States Patent
Arquilla

(10) Patent No.: US 9,839,259 B2
(45) Date of Patent: Dec. 12, 2017

(54) ADHESIVE, WASHABLE, ANTIMICROBIAL INSERT LINER FOR SHOES AND METHOD OF MANUFACTURING THE SAME

(71) Applicant: JCA INVESTMENT HOLDINGS INC., New York, NY (US)

(72) Inventor: Justin Arquilla, New York, NY (US)

(73) Assignee: JCA Investment Holdings, Inc., New York, NY (US)

( * ) Notice: Subject to any disclaimer, the term of this patent is extended or adjusted under 35 U.S.C. 154(b) by 253 days.

(21) Appl. No.: 14/040,893

(22) Filed: Sep. 30, 2013

(65) Prior Publication Data

US 2014/0090274 A1 Apr. 3, 2014

Related U.S. Application Data

(60) Provisional application No. 61/709,087, filed on Oct. 2, 2012.

(51) Int. Cl.
*A43B 3/24* (2006.01)
*A43B 13/14* (2006.01)
(Continued)

(52) U.S. Cl.
CPC ..... *A43B 13/14* (2013.01); *A43B 1/0045* (2013.01); *A43B 17/18* (2013.01); *A43B 19/00* (2013.01)

(58) Field of Classification Search
CPC ..... A43B 17/18; A43B 19/00; A43B 3/106; A43B 1/0081; A43B 11/008
(Continued)

(56) References Cited

U.S. PATENT DOCUMENTS 1,803,554 A * 5/1931 Knilans ..... A43B 5/00 36/114
2,154,682 A * 4/1939 Johnson ..... B03C 7/06 209/127.2
(Continued)

FOREIGN PATENT DOCUMENTS

DE 102006031951 A1 1/2008
EP 1 629 738 A1 3/2006
(Continued)

OTHER PUBLICATIONS

International Search Report and Written Opinion for corresponding International application No. PCT/US2013/062885, dated May 7, 2014, 9 pages.
(Continued)

*Primary Examiner* — Jila M Mohandesi
(74) *Attorney, Agent, or Firm* — Stinson Leonard Street LLP

(57) ABSTRACT

A shoe insert liner or no-show sock configured to detachably adhere to an interior cavity of a shoe is provided. In one embodiment, the shoe insert liner includes a liner having an exterior surface and an adhesive bonded to at least a portion of the exterior surface of the liner. The liner includes a longitudinal portion, opposing first and second lateral portions extending in a first direction from opposite sides of the longitudinal portion, and opposing front and rear portions extending in the first direction from opposite ends of the longitudinal portion. Together, the longitudinal, lateral, front, and rear portions of the liner define an interior cavity and an opening configured to receive a user's foot.

16 Claims, 7 Drawing Sheets

(51) Int. Cl.
*A43B 1/00* (2006.01)
*A43B 17/18* (2006.01)
*A43B 19/00* (2006.01)

(58) Field of Classification Search
USPC ..... 36/43, 44, 71
See application file for complete search history.

(56) References Cited

U.S. PATENT DOCUMENTS 2,584,516 A 2/1952 Veatch
4,645,466 A * 2/1987 Ellis ..... B63B 35/7936 114/39.16
4,694,590 A * 9/1987 Greenawalt ..... A43B 7/1415 36/163
4,813,162 A * 3/1989 Harris ..... A43B 3/108 36/11.5
5,092,347 A * 3/1992 Shaffer ..... A61F 13/064 128/892
5,154,682 A 10/1992 Kellerman
5,595,005 A * 1/1997 Throneburg ..... A41B 11/00 36/10
5,740,618 A * 4/1998 Minden ..... A43B 5/12 36/71
6,393,734 B1 5/2002 Ou
7,010,872 B2 * 3/2006 Pawlus ..... A43B 3/0047 36/100
7,047,671 B2 * 5/2006 Steed ..... A43B 13/24 36/43
7,171,768 B2 * 2/2007 Klein ..... A43B 3/24 36/101
7,434,336 B2 * 10/2008 Kosted ..... A43B 1/0081 36/10
8,056,149 B2 * 11/2011 Duclos ..... A43B 19/00 2/239
8,181,363 B2 * 5/2012 Klein ..... A43B 3/24 36/10
8,424,117 B2 * 4/2013 Hasan ..... A41B 11/02 2/239
9,392,836 B2 * 7/2016 Hatfield ..... A43B 3/24
2002/0066209 A1 6/2002 Steed et al.
2005/0011083 A1 * 1/2005 Kosted ..... A43B 1/0081 36/9 R
2006/0021252 A1 * 2/2006 Throneburg ..... A43B 7/16 36/44
2006/0177645 A1 * 8/2006 Baychar ..... A43B 5/0405 428/304.4
2006/0277797 A1 12/2006 McLinden
2007/0271819 A1 * 11/2007 Chen ..... A41B 11/008 36/43
2008/0115385 A1 * 5/2008 McLinden ..... A43B 7/1425 36/44
2009/0282705 A1 * 11/2009 Trigillo ..... A43B 7/142 36/3 B
2012/0148778 A1 * 6/2012 Dawkins ..... A43B 17/102 428/40.1
2012/0227281 A1 9/2012 Young
2012/0304493 A1 * 12/2012 Hudson ..... A43B 7/28 36/83

FOREIGN PATENT DOCUMENTS

FR 2807628 A1 10/2001
GB 1124192 A 8/1968
WO 9732498 A1 9/1997

OTHER PUBLICATIONS

Extended European Search Report EP13844360, dated May 25, 2016, 8 pages.

* cited by examiner

ADHESIVE, WASHABLE, ANTIMICROBIAL INSERT LINER FOR SHOES AND METHOD OF MANUFACTURING THE SAME

CROSS-REFERENCE TO RELATED APPLICATION(S)

This application claims priority to and the benefit of U.S. Provisional Application Ser. No. 61/709,087, filed Oct. 2, 2012, the entire contents of which are herein incorporated by reference.

FIELD OF THE INVENTION

The present invention relates generally to an insert liner sock for a shoe, and more particularly to a removable insert liner sock and a method of manufacturing the same.

BACKGROUND

Certain types of shoes are commonly worn without socks, such as casual loafers, flats, dress shoes, boat shoes, etc. However, wearing shoes without socks can produce a bad odor from bacteria buildup caused by moisture generated by the user's sweaty feet. Additionally, wearing shoes without socks may cause the user's foot to slip around in the shoe due to moisture buildup. Moreover, the user's foot may uncomfortably stick to the inside of the shoe due to the production of moisture by the user's foot.

Conventional apparatuses may include low-cut socks, such as "loafer socks," which may provide the appearance that the user is not wearing socks. However, such conventional low-cut socks may inadvertently slip off the user's foot, such as when the user removes the shoe, because the socks do not extend up around the user's ankle. Moreover, such low-cut socks may inconveniently require frequent adjustment by the user to prevent the socks from slipping off the user's lower ankles and heels. Furthermore, conventional low-cut socks may include an additional mechanism for securing the socks to the user's ankles, such as an elastic band or hook and loop fasteners. These mechanisms, however, may be uncomfortable or unseemly. Additionally, these mechanisms require the user to locate and dress such low-cut socks each time the user wishes to wear shoes with low-cut socks. Other conventional solutions may include applying powder to the interior cavity of the shoe to absorb excess moisture from the user's foot. However, applying powder to the interior cavity of the user's shoes may require multiple applications per day, which creates additional expense and increases the user's inconvenience. Additionally, it may be cumbersome or awkward for the user to carry a bottle of powder around such that the powder is readily accessible for multiple reapplications throughout the day.

As a result, there is a need for a removable insert liner or low-cut sock configured to be detachably adhered to an interior cavity of a shoe such that the user can comfortably wear shoes without socks. There is also a need for an insert liner or low-cut sock which is configured to be removed from the shoe, machine washed, and subsequently re-adhered to the interior cavity of the shoe until the user desires to wash the insert liner or sock again. There is also a need to provide an odor killing antimicrobial adhesive liner configured to wick moisture away from the user's foot, thereby allowing the user to keep the insert liner inside the shoe for numerous wears without needing to wash the insert liner.

SUMMARY

The present disclosure is directed to an antimicrobial shoe insert liner which is configured to detachably adhere to an interior cavity of a shoe. In one embodiment, the shoe insert liner includes a liner having an exterior surface and an adhesive bonded to at least a portion of the exterior surface of the liner. The liner includes a longitudinal portion, opposing first and second lateral portions extending in a first direction from opposite sides of the longitudinal portion, and opposing front and rear portions extending in the first direction from opposite ends of the longitudinal portion. Together, the longitudinal, lateral, front, and rear portions of the liner define an opening configured to receive a user's foot. The shoe insert liner may be configured to fit into any type of shoe, such as, loafers, boat shoes, slip on shoes, formal work shoes, oxfords, flats, etc. The adhesive may be any suitable type of adhesive, such as polyurethane or silicone. In one embodiment, the adhesive may be a gel adhesive. Any suitable portion of the liner may include adhesive. In one embodiment, only a portion of the front portion of the liner includes adhesive. In another embodiment, no portion of the front portion of the liner includes adhesive. In one embodiment, the adhesive includes pores configured to provide ventilation. Additionally, the liner may be comprised of any suitable material. In one embodiment, the liner comprises an elastomeric material. In another embodiment, the liner comprises a fabric configured to wick moisture away from the user's foot. In yet another embodiment, approximately 5 to 100 percent of the liner comprises an antimicrobial material. In a further embodiment, the shoe insert liner also includes a removable protective sheet covering the adhesive.

The present disclosure is also directed to a shoe assembly. In one embodiment, the shoe assembly includes a shoe having an interior cavity and a shoe insert liner configured to be releasably adhered to at least a portion of the interior cavity of the shoe. The interior cavity of the shoe defines a pair of opposing sidewalls, a heel portion, a toe portion opposite the heel portion, a tongue portion, an insole portion extending between the toe and heel portions, and a collar portion extending around a periphery of an opening configured to receive a user's foot. The shoe insert liner includes a liner having an exterior surface and an adhesive bonded to at least a portion of the exterior surface of the liner. In one embodiment, when the shoe insert liner is releasably adhered to the interior cavity of the shoe, the shoe insert liner extends below the collar portion of the shoe. In one embodiment, the shoe insert liner is releasably adhered to the heel, sidewall, insole, and tongue portions of the shoe. In another embodiment, the shoe insert liner is releasably adhered to the tongue portion of the shoe and the shoe insert liner is not adhered to the toe portion of the shoe such that a front portion of the shoe insert liner is configured to stretch forward toward the toe portion of the shoe when a user's foot is inserted into the shoe insert liner. In one embodiment, when the shoe insert liner is removed from the shoe, substantially no adhesive material remains bonded to the interior cavity of the shoe or bleeds onto the interior cavity of the shoe.

The present disclosure is also directed to a method of manufacturing a shoe insert liner. In one embodiment, the method includes fabricating a fabric layer, applying adhesive to portions of the fabric layer, and curing the adhesive to form the shoe insert liner. In one embodiment, fabricating the fabric layer includes knitting the fabric layer on a sock knitting machine. In one embodiment, applying adhesive to portions of the fabric layer includes dressing the fabric layer on a mold, masking portions of the fabric layer, and spraying unmasked portions of the fabric layer with an adhesive gel using a meter mix automated spray coating machine. In another embodiment, applying adhesive to portions of the fabric layer includes dressing the fabric layer on a mold, masking portions of the fabric layer, and passing the fabric layer through a multiple station meter mix dispense coating system that applies an adhesive gel to the fabric layer. In another embodiment, no masking is necessary given the accuracy of the spray coating machine. In another embodiment, fabricating the fabric layer includes trimming a sheet material, such as by die cutting, to form a flat pattern. A periphery of the flat pattern includes a plurality of seam lines that are configured to be connected together, such as by stitching, to form the shoe insert liner. In one embodiment, the method of manufacturing a shoe insert liner also includes applying a release liner to the adhesive.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

Embodiments of insert liners for a shoe and methods of manufacturing the same are described with reference to the following figures. The same reference numerals are used throughout the figures to reference like features, components, and method steps.

DETAILED DESCRIPTION

Figure 1A:
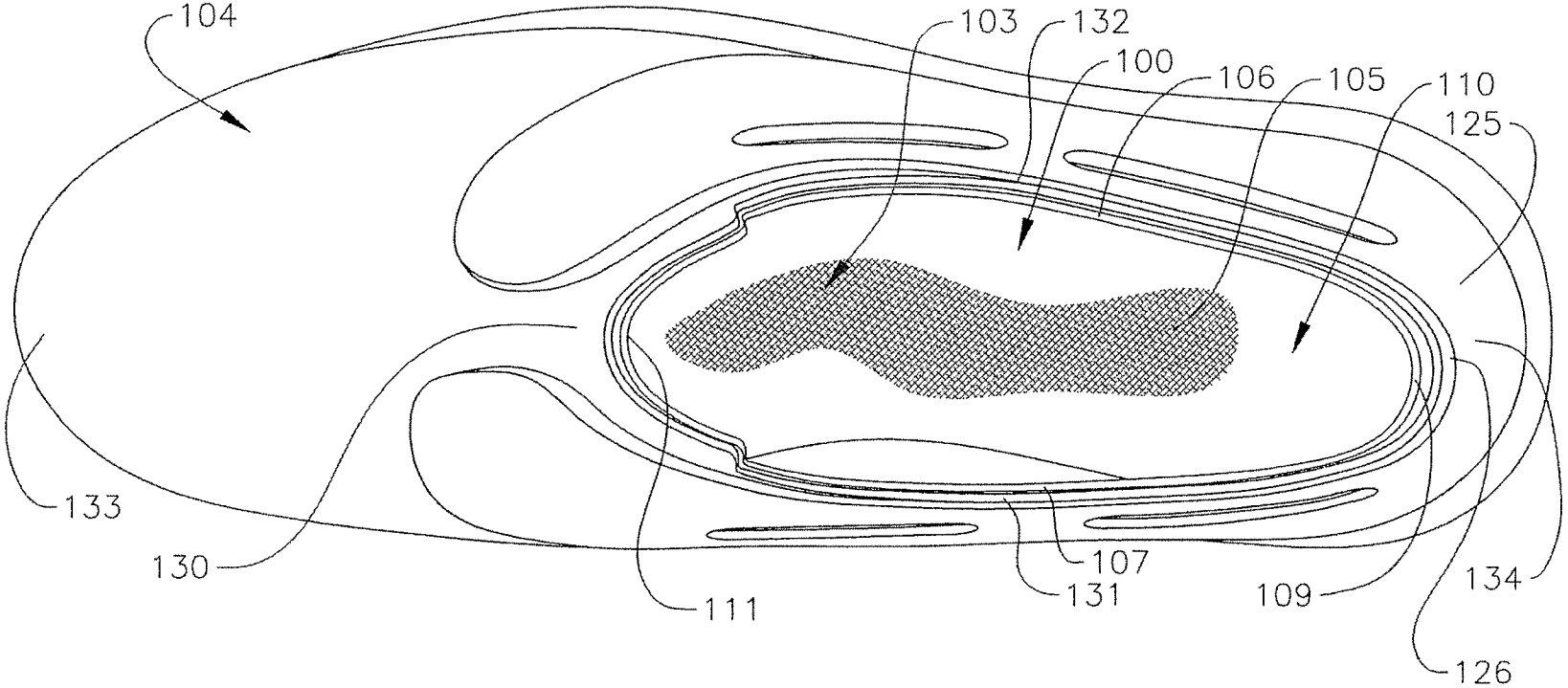
FIG. 1A is a top view of an insert liner detachably bonded to an interior cavity of a shoe according to an embodiment of the present disclosure.

The present invention relates to an insert liner for a shoe, and more particularly to a detachable insert liner and a method of manufacturing the same. The shoe insert liner is configured to detachably adhere to the interior cavity of the shoe with the application of positive pressure. The shoe insert liner is configured to generally conform to the contour of at least a portion of the interior cavity of the shoe. The shoe insert liner is secured to at least a portion of the interior cavity of the shoe with a temporary bond, such that the user may detach the insert liner from the shoe as desired. Moreover, the shoe insert liner may be removed from the interior cavity of the shoe and subsequently re-inserted without the need to apply additional adhesive material. Additionally, the adhesive shoe insert liner is machine-washable such that the insert liner retains its adhesive properties after washing. The shoe insert liner may also be configured to be completely recessed in the interior cavity of the shoe such that the shoe insert liner does not extend above a collar portion of the shoe, which tends to conceal the shoe insert liner from view by other individuals. In one embodiment, the shoe insert liner is configured to wick moisture away from the user's foot. In a further embodiment, the shoe insert liner may be comprised of an antimicrobial material. The shoe insert liner may be provided in various shapes and sizes such that the insert liner is configured for use with a variety of different shoes, such as loafers, dress shoes, boots, oxford shoes, women's flats, high heels, etc.

With reference now to FIGS. 1A-2B, a shoe insert liner 100 according to an embodiment of the present invention is illustrated. The shoe insert liner 100 comprises a fabric layer 101 and a pressure-sensitive adhesive layer 102 bonded to at least a portion of an exterior surface of the fabric layer 101. It will be appreciated that the pressure-sensitive adhesive layer 102 is configured to detachably adhere the shoe insert liner 100 to the interior cavity 103 of a shoe 104, and the fabric layer 101 is configured to wick moisture away from the user's foot and provide comfort to the user. In one embodiment, the shoe insert liner 100 comprises a longitudinal portion 105, opposing lateral portions 106, 107 extending upward from opposite sides of the longitudinal portion 105, and opposing front and rear portions 108, 109 extending upward from opposite ends of the longitudinal portion 105. As described in detail below with reference to FIG. 5, forward edges of the lateral portions 106, 107 of the liner 100 are connected to the front portion 108 by any suitable means, such as stitching. Similarly, rear edges of the lateral portions 106, 107 of the liner 100 are connected to the rear portion 109 by any suitable means. In one or more alternate embodiments, the liner 100 may be made via a sock knitting machine, thereby eliminating the need for any additional stitching. Connecting the lateral portions 106, 107 to the front portion 108 and the rear portion 109 forms a cavity 110 configured to receive the user's foot through an opening 111.

The shoe insert liner 100 of the present disclosure is configured to be received in the interior cavity 103 of the shoe 104. The interior cavity 103 of the shoe 104 comprises opposing short sidewalls 131, 132, forward toe and tongue portions 133, 130, respectively, a rear heel portion 134, and a bottom/insole portion 135 extending longitudinally between the toe and heel portions 133, 134 and extending laterally between lower ends of the opposing sidewalls 131, 132. When the shoe insert liner 100 is inserted into the interior cavity 103 of the shoe 104, the longitudinal, lateral, front, and rear portions 105, 106, 107, 108, 109, respectively, of the liner 100 are configured to substantially conform to the sole, sidewall, tongue, and heel portions of the shoe 104, respectively. In one embodiment, the insert liner 100 extends from an upper edge of the tongue portion 130 of the shoe 104 to a region approximately midway between the toe portion 133 and the upper edge of the tongue portion 130 of the shoe 104. In an alternate embodiment, the liner 100 may cover the entire portion of the interior cavity 103 extending between the toe portion 133 and the upper edge of the tongue portion 130 of the shoe 104. It will be appreciated, however, that the liner 100 may be configured to extend any desired amount between the toe 133 and tongue 130 portions of the shoe 104.

Figures 2A, 2B:
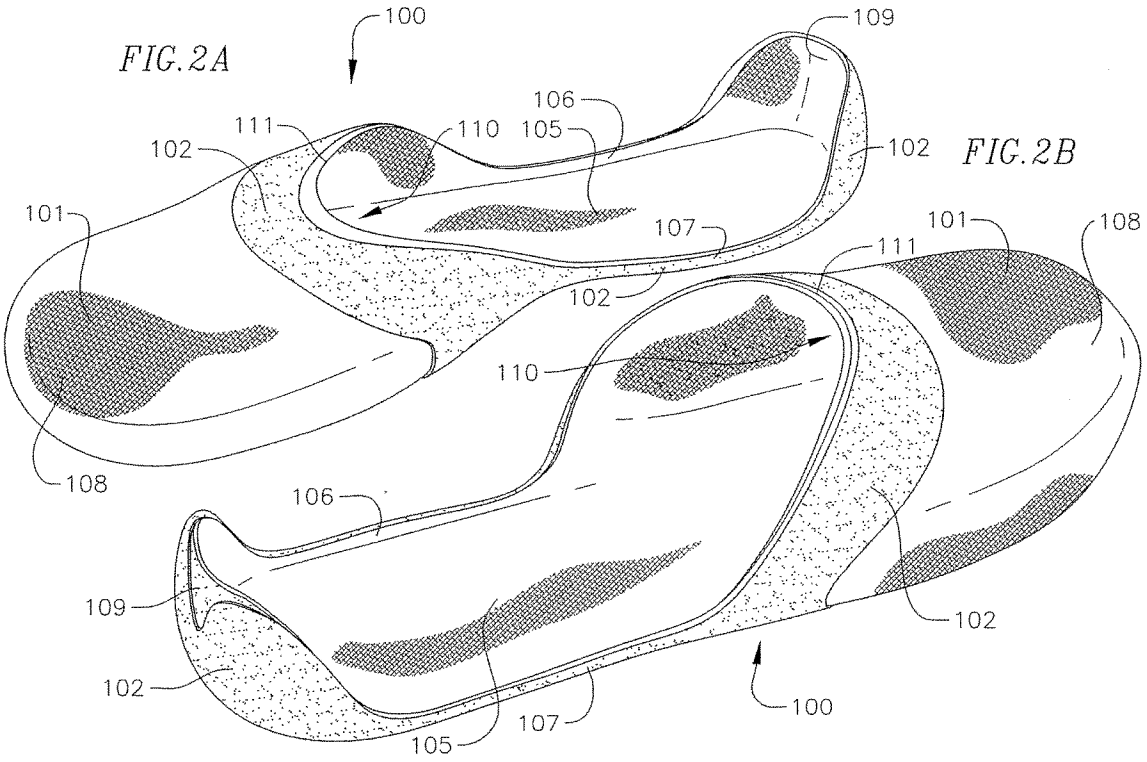
FIGS. 2A and 2B are front and rear perspective views, respectively, of the insert liner of FIG. 1A.
Figure 3A:
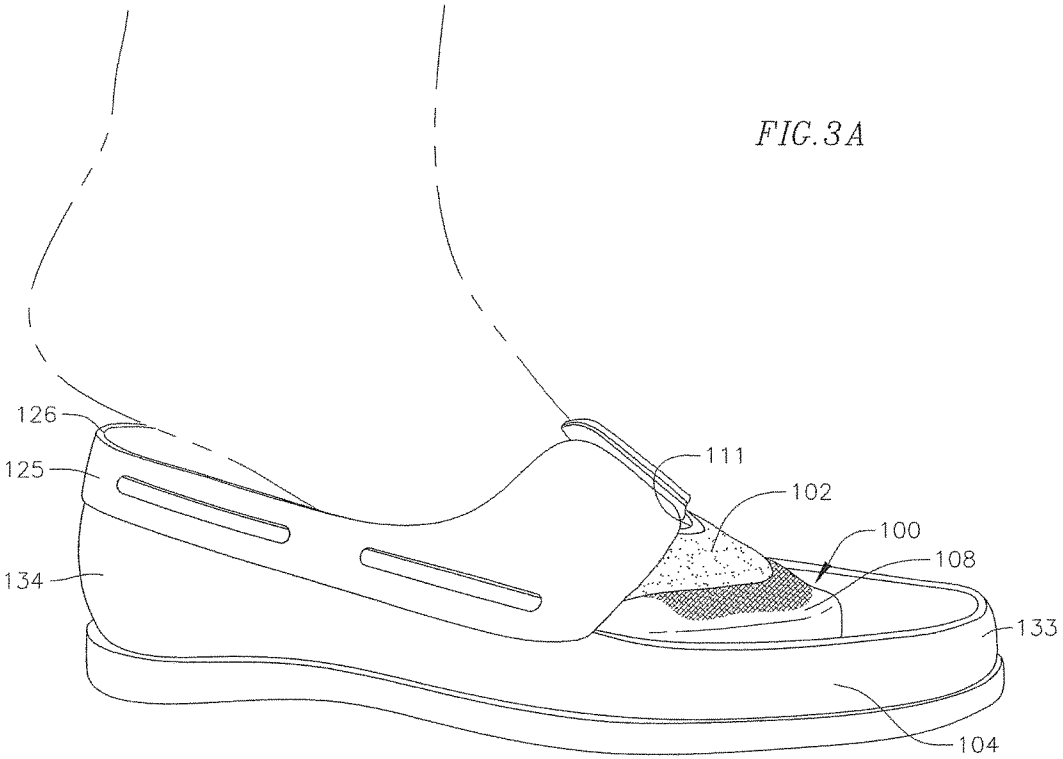
FIG. 3A is a perspective view of a user's foot partially inserted into the insert liner and shoe of FIG. 1B.
Figure 3B:
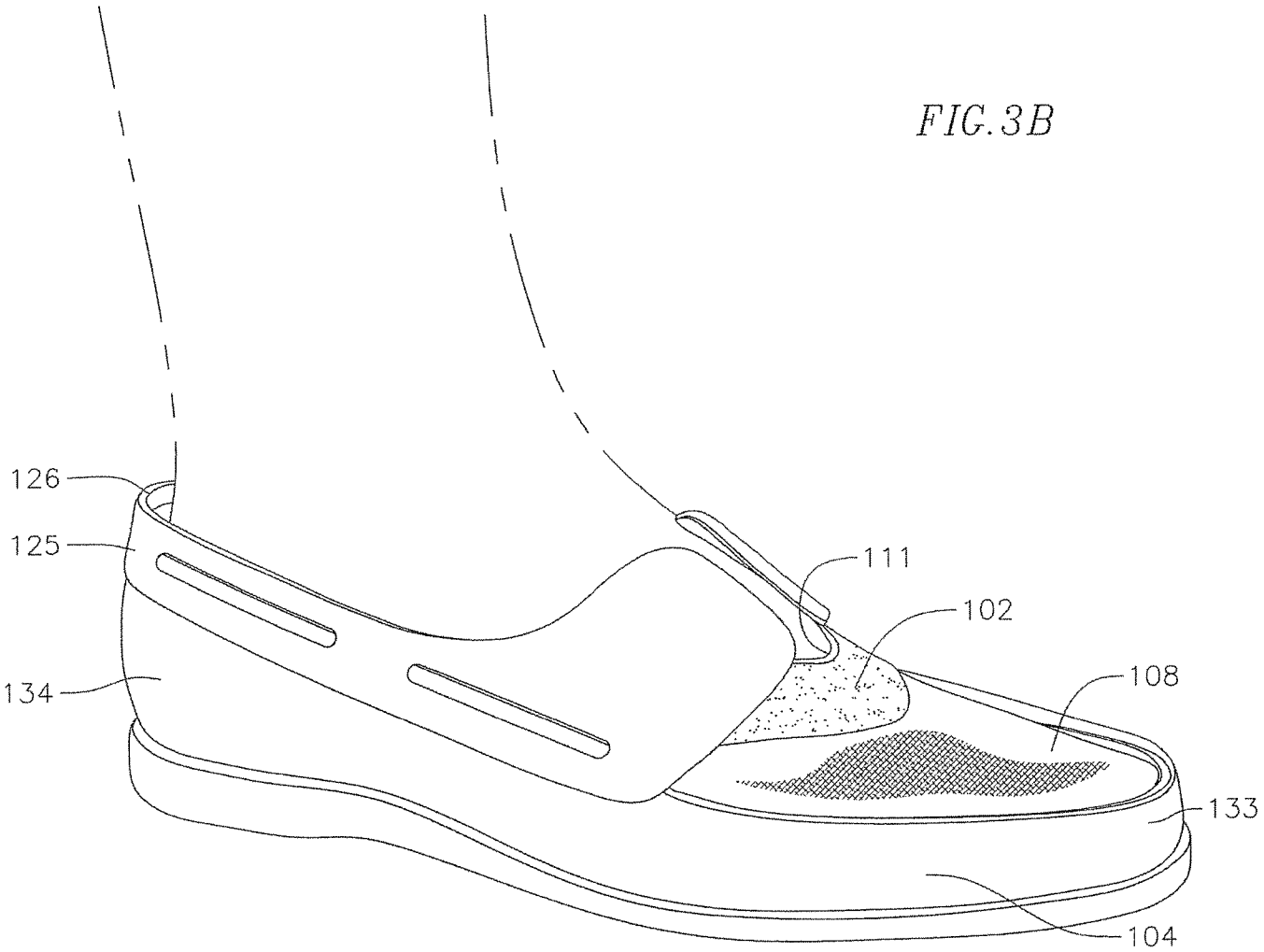
FIG. 3B is a perspective view of a user's foot fully inserted into the insert liner and shoe of FIG. 1B, showing the insert liner stretched to conform to the user's foot.

Moreover, as described in more detail below, the adhesive 102 may be applied to any desired amount of the fabric layer 101. The contact between the adhesive layer 102 and the interior cavity 103 of the shoe 104 detachably adheres the liner 100 to the shoe 104. In the illustrated embodiment of FIGS. 2A and 2B, the adhesive 102 is applied to the rear portion 109, the opposing lateral portions 106, 107, and only a portion of the front portion 108 of the fabric layer 101. In the illustrated embodiment, the adhesive 102 is applied only to the portion of the front portion 108 which engages the tongue portion 130 of the shoe 104 when the insert liner 100 is inserted into the interior cavity 103 of the shoe 104. In the illustrated embodiment, the adhesive 102 is not applied to the front portion 108 of the fabric layer 101 which corresponds to the toe portion 133 of the shoe 104. This permits the front portion 108 of the shoe insert liner 100 to stretch forward as the user's foot is inserted into the cavity 110 of the insert liner 100, as illustrated in FIGS. 3A and 3B. That is, the portion of the front portion 108 of the fabric liner 100 corresponding to the toe portion 133 of the shoe 104 may be free of any adhesive 102 such that the front portion 108 is configured to function in the same manner as a toe section of a conventional dress sock or no-show sock. Accordingly, in the embodiment illustrated in FIG. 1B, the front portion 108 of shoe insert liner 100 is spaced apart from the toe portion 133 of the shoe 104 when a user's foot is not inserted into the cavity 110 of the shoe insert liner 100. Then, as the user's foot is inserted into the interior cavity 110 of the shoe insert liner 100, the front portion 108 of the insert liner 100 is configured to stretch forward toward the toe portion 133 of the shoe 104, thereby conforming to the shape of the user's foot thus allowing the fabric layer 101 to grip the user's foot tightly which enhances the wicking and antimicrobial abilities of the yarns. FIG. 3A illustrates a user's foot enter the shoe insert liner 100 with the front portion 108 unstretched, and FIG. 3B illustrates the front portion of the shoe insert liner 100 stretched around the user's foot when the user's foot is fully inserted into the shoe insert liner 100 and shoe 104. Additionally, the adhesive 102 on the front portion 108 of the shoe insert liner 100 adheres to the tongue portion 130 of the shoe 104 and thereby maintains the opening 111 in the shoe insert liner 100 such that the user's bare foot may be readily inserted into the cavity 110 of the shoe insert liner 100. Furthermore, the adhesive bond between the shoe insert liner 100 and the tongue portion 130 of the shoe 104 provides a counter-pulling force as the user's foot is inserted into the cavity 110 in the shoe insert liner 100, thereby allowing the front portion 108 of the shoe insert liner 100 to be stretched snuggly around the user's foot (i.e., the shoe insert liner 100 is configured to remain adhered to the tongue portion 130 of the shoe 104 as the user's foot is inserted into the cavity 110 of the shoe 104 such that the front portion 108 of the shoe insert liner 100 may stretch toward the toe portion 133 of the shoe 104 and thereby conform to a portion of the user's foot).

In one embodiment, between approximately 5% and approximately 100% of the fabric layer 101 comprises an antimicrobial material. It will be appreciated, however, that the proportion of the fabric layer 101 comprising antimicrobial material is not limited to the amounts recited above, and any desired amount of antimicrobial material may be provided depending upon the conditions in which the shoe insert liner 100 will be used. In one embodiment, the fabric layer 101 comprises a material configured to wick moisture away from the user's foot. In another embodiment, the fabric layer 101 comprises an elastomeric material, such as spandex. In one embodiment, approximately 5% of the fabric layer 101 comprises spandex. It will be appreciated, however, that the fabric layer 101 may be comprised of a greater or lesser proportion of elastomeric material depending upon the desired elasticity of the shoe insert liner 100.

Figure 6:
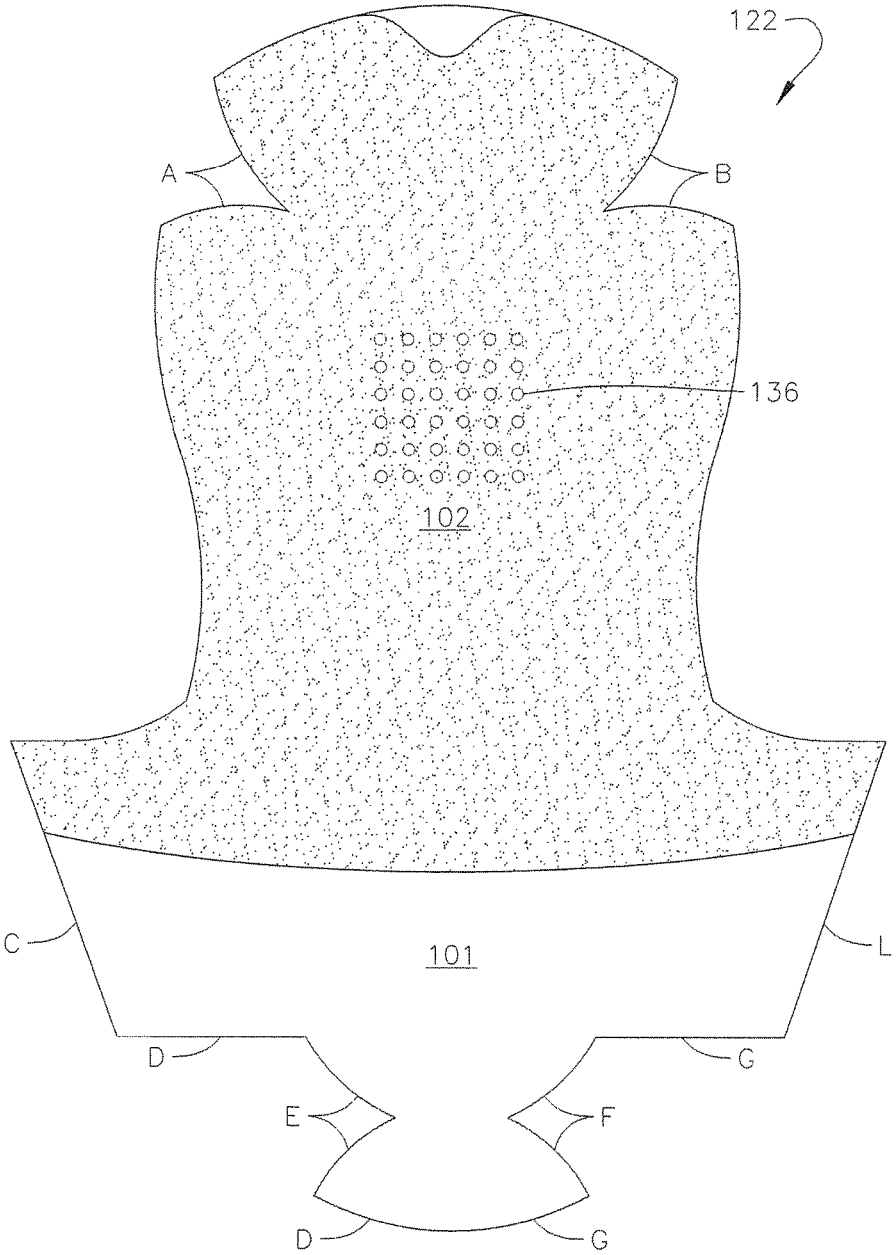
FIG. 6 is a top view of a flat pattern layout of an insert liner according to an embodiment of the invention showing the seam pattern of the inner liner prior to final assembly.

In one embodiment, the adhesive layer 102 comprises silicone adhesive. In another embodiment, the adhesive layer 102 comprises a cured silicone rubber gel with a tacky surface. In another embodiment, the adhesive layer 102 comprises a two-part polyurethane gel. The two-part polyurethane gel adhesive 102 cures with a tacky surface configured to releaseably adhere the shoe insert liner 100 to the shoe 104. The two-part polyurethane gel adhesive 102 may also be configured to cure with sufficient hardness to maintain the general shape of the shoe insert liner 100 (i.e., the polyurethane gel adhesive layer 102 may be configured to maintain the shape of the insert liner 100 such that it generally matches the shape of the interior cavity 103 of the shoe 104 even when the shoe insert liner 100 is removed from the shoe 104). In one embodiment, when the shoe insert liner 100 is detached from the shoe 104, substantially no adhesive remains on the shoe 104 or bleeds onto the interior cavity 103 of the shoe 104. Additionally, in one embodiment, the adhesive 102 includes a plurality of small holes or pores 136 configured to provide ventilation for the user's foot (i.e., the pores 136 in the adhesive layer 102 are configured to permit air to circulate to the user's foot). The pores 136 may be provided along any portions of the adhesive layer 102 where ventilation is desired, such as, for instance, in the portion of the adhesive layer 102 provided along the longitudinal portion 105 of the shoe insert liner 100, as illustrated in FIG. 6. The pores 136 may also be provided in the portion of the adhesive layer 102 provided along the rear portion 109, the opposing lateral portions 106, 107, and/or the front portion 108 of the shoe insert liner 100.

Figure 1B:
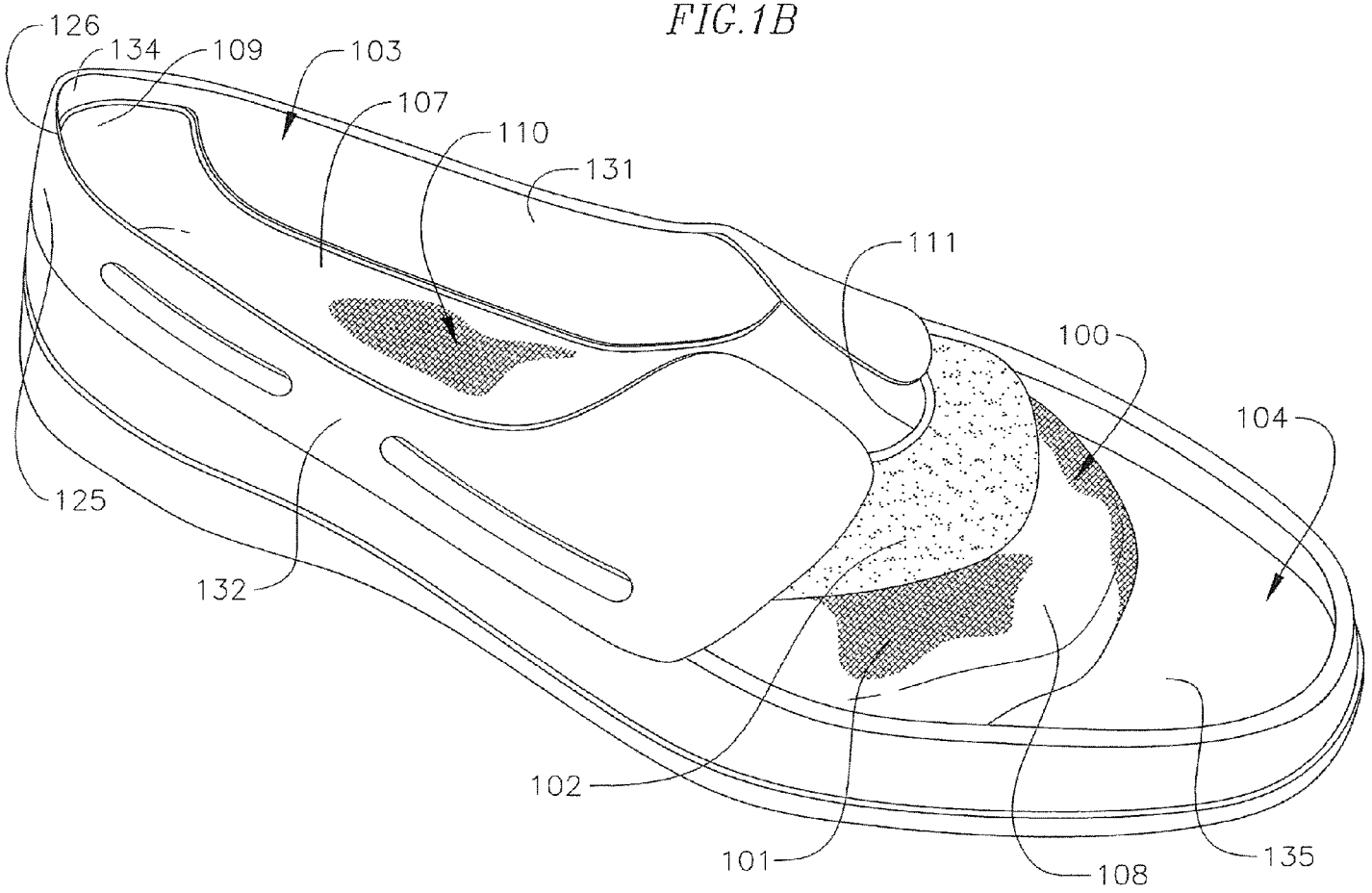
FIG. 1B is a perspective view of the insert liner and the shoe of FIG. 1A, with a tongue portion of the shoe omitted to reveal a toe portion of the insert liner.

With reference again to the embodiment illustrated in FIG. 1B, the shoe insert liner 100 of the present invention may be configured not to extend above a collar portion 125 of the shoe 104 when the shoe insert liner 100 is adhered to the interior cavity 103 of the shoe 104 (i.e., the shoe insert liner 100 may be configured to extend slightly below an upper edge 126 of the collar portion 125 of the shoe 104). Recessing the shoe insert liner 100 below the upper edge 126 of the collar portion 125 of the shoe 104 tends to conceal the shoe insert liner 100 from view by other individuals. That is, the shoe insert liner 100 may be configured such that the shoe insert liner 100 is not visible during use. In this way, the shoe insert liner 100 is configured to maintain the desired sockless appearance.

The shoe insert liner 100 of the present disclosure may be adhered to the interior cavity 103 of the shoe 104 without the aid of an applicator device. In one embodiment, the user may use his or her hand to place the shoe insert liner 100 into the shoe 104 much like a conventional arch support and then supply the pressure necessary to detachably adhere the pressure-sensitive adhesive layer 102 of the shoe insert liner 100 to the interior walls of the shoe 104. In one embodiment, the user may then insert his or her foot into the cavity 110 of the shoe insert liner 100 and then step into the shoe 104. The user may then move his or her foot in multiple directions to apply the requisite pressure to detachably adhere the shoe insert liner 100 to the shoe 104. The user may alternately use his or her hand to apply the necessary pressure to detachably adhere the shoe insert liner 100 to the interior cavity 103 of the shoe 104. It will be appreciated that in the embodiment in which the front portion 108 of the shoe insert liner 100 is not configured to adhere to the toe portion 133 of the shoe 104, the user needs to apply pressure only to the rear portion 109, the longitudinal portion 105, the lateral portions 106, 107, and a portion of the front portion 108 of the shoe insert liner 100, such that the shoe insert liner 100 is adhered to the heel portion 134, the insole/bottom portion 135, the sidewall portions 131, 132, and the tongue portion 130, respectively, of the interior cavity 103 of the shoe 104.

Figure 4:
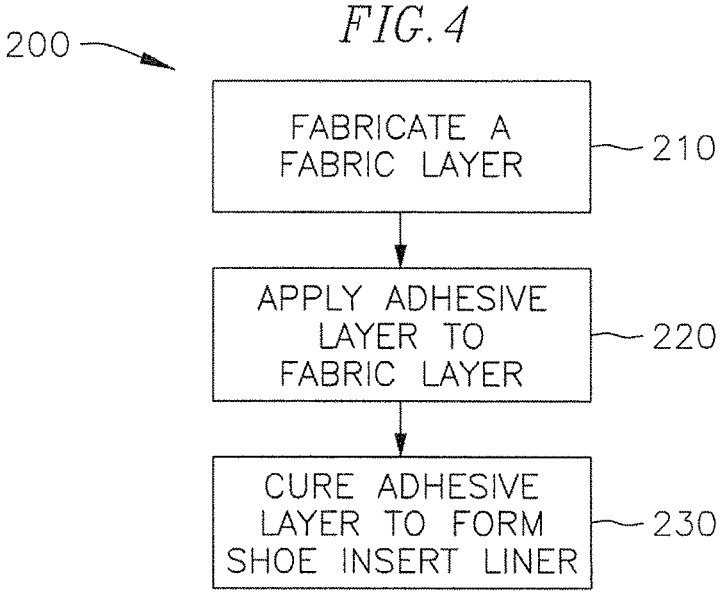
FIG. 4 is a flowchart showing steps of manufacturing a shoe insert liner according to an embodiment of the present disclosure.

Referring now to FIG. 4, a flowchart illustrating a method 200 of manufacturing a shoe insert liner 100 according to one embodiment of the present disclosure is provided. In the illustrated embodiment, the method 200 includes a task 210 of fabricating a fabric layer 101. The task 210 of fabricating the fabric layer 101 may be performed by any suitable means, such as, for instance, knitting on a sock knitting machine. The method 200 also includes a task 220 of applying an adhesive layer 102 to the fabric layer 101. The task 220 of applying an adhesive layer 102 to the fabric layer 101 may be performed by any suitable means. In one embodiment, the task 220 includes dressing the fabric layer 101 onto a mold in the shape of an interior cavity 103 of a shoe 104. The mold also includes an exterior mask that covers any portions of the fabric layer 101 that are not to receive the adhesive layer 102. The task 220 of applying the adhesive layer 102 to the fabric layer 101 also includes placing the fabric layer 101, which is dressed on the masked mold, onto an inline conveyer. The inline conveyor is configured to transport the mold and fabric layer 101 toward a robotic arm and a multi-axis automated spray machine. When the masked mold and fabric layer 101 arrives at the spray machine, the robotic arm lifts the masked mold and fabric layer 101 into a spray zone of the automated spray machine. The automated spray machine then sprays the fabric layer 101 with an adhesive gel material, such as, for instance, silicone or polyurethane. In an alternate embodiment, the fabric layer 101, which is dressed on the masked mold, is passed into a dispensing zone where a meter mixed dispense coating system coats different sides and contours of the fabric layer 101 in different stages. It will be appreciated that the adhesive gel material will only be applied to those portions of the fabric layer 101 that are not covered by exterior mask on the mold. In one embodiment, exterior mask is configured such that the adhesive gel material is only applied to the rear portion 109, the longitudinal portion 105, the lateral portions 106, 107, and a portion of the front portion 108 of the shoe insert liner 100 that corresponds to the tongue portion 130 of the shoe 104, as illustrated in FIGS. 2A and 2B. In one or more alternate embodiments, the exterior mask on the mold may have any other suitable configuration such that any other suitable portions of the fabric layer 101 will receive adhesive 102. Additionally, the mask may be configured such that a plurality of small holes or pores 136 are formed in the adhesive layer 102 to provide ventilation for the user's foot, as described above and illustrated in FIG. 6. The method 200 also includes a task 230 of curing the adhesive layer 102 on the fabric layer 101 to form the completed shoe insert liner 100. In one embodiment, the task 230 of curing the adhesive layer 102 includes placing the mold, onto which the adhesive coated fabric layer 101 is dressed, onto an inline conveyer oven. Placing the mold and adhesive coated fabric layer 101 onto the inline conveyor oven may be performed by any suitable means, such as, for instance, manually or mechanically, such as with an automated robotic arm.

Figure 5:
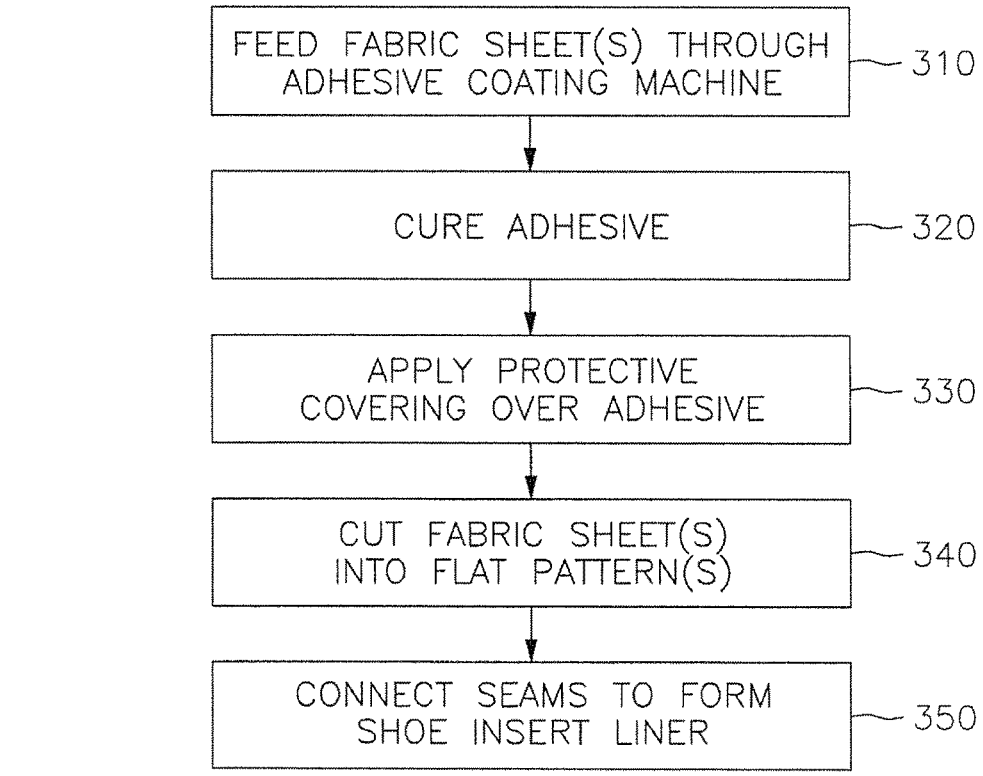
FIG. 5 is a flowchart showing steps of manufacturing a shoe insert liner according to another embodiment of the present disclosure.

With reference now to FIG. 5, a flowchart illustrating a method 300 of manufacturing a shoe insert liner 100 according to another embodiment of the present disclosure is provided. In the illustrated embodiment, the method 300 includes a task 310 of unfurling fabric sheets from a spool and feeding the fabric sheets through an adhesive coating machine. The adhesive coating machine applies an adhesive 102, such as silicone or polyurethane, to one side of the fabric layer 101. In one embodiment, the opposite side of the fabric layer 101 is not coated such that one side of the fabric layer 101 remains exposed. As described above, exposing one side of the fabric layer 101 promotes wicking moisture away from the user's foot during use of the shoe insert liner 100. In one embodiment, the adhesive 102 covers substantially all of one side of the fabric layer 101 (i.e., the adhesive layer 102 may be substantially coextensive with the fabric layer 101). In an alternate embodiment, the adhesive layer 102 may be applied only to localized regions of one side of the fabric layer 101. In one embodiment, the adhesive 102 is applied only to the rear portion 109, the longitudinal portion 105, the lateral portions 106, 107, and a portion of the front portion 108 of the shoe insert liner 100 that corresponds to the tongue portion 130 of the shoe 104, as illustrated in FIGS. 2A and 2B. Providing no adhesive along the portion of the shoe insert liner 100 that corresponds to the toe portion 133 of the shoe 104 tends to conform this portion of the shoe insert liner 100 to the user's foot, as illustrated in FIG. 3B, which tends to aid in wicking moisture from the user's foot. The amount and location of adhesive 102 applied may depend upon the desired strength of the bond between the shoe insert liner 100 and the shoe 104. In one embodiment, the fabric sheet is approximately 12 inches wide, although the fabric sheet may be narrower or wider depending upon the size of the shoe 104 for which the shoe insert liner 100 is intended to be used. The method 300 of manufacturing the shoe insert liner 100 also comprises a task 320 of curing the adhesive layer 102 formed on one side of the fabric layer 101. In one embodiment, a curing machine is configured to supply a heat source which cures the adhesive layer 102 to the fabric layer 101. In one embodiment, the method 300 of manufacturing the shoe insert liner 100 also includes a task 330 of applying a protective covering, such as a thin film, to cover the adhesive layer 102. The protective covering is configured to prevent contamination of the adhesive layer 102 during the remaining manufacturing processes and during packaging and shipping. Moreover, the protective covering is configured to be removed from the adhesive layer 102 prior to insertion of the shoe insert liner 100 into the interior cavity 103 of the shoe 104.

With continued reference to FIG. 5, the method 300 of manufacturing the shoe insert liner 100 may include a task 340 of cutting the fabric sheet 101 having an adhesive layer 102 into a flat pattern with a cutting mechanism. The cutting mechanism may be any machine suitable for cutting fabric, such as a die cutting machine or a laser cutting machine. In one embodiment, the fabric sheet 101 having the adhesive layer 102 is cut into the flat pattern 122 illustrated in FIG. 6. The flat pattern 122 has portions corresponding to the front portion 108, the opposing lateral portions 106, 107, the longitudinal portion 105, and the rear portion 109 of the finished shoe insert liner 100. As illustrated in FIG. 6, the periphery of the flat pattern 122 includes seam portions A, B, C, D, E, F, and G. In one embodiment, the method 300 comprises a task 350 of connecting seam portions with like reference characters, such as by stitching or bonding, to form the shoe insert liner 100. Specifically, opposing edges C of the flat pattern 122 are configured to be connected together to form the lateral portions 106, 107 of the shoe insert liner 100. Edges A and B, respectively, are configured to be connected together to form the rear portion 109 of the shoe insert liner 100. Edges D, E, F, and G, respectively, are configured to be connected together to form the front portion 108 of the shoe insert liner 100. It will be appreciated by a person of ordinary skill in the art that the edges of the flat pattern 122 must be folded in the same direction to produce the cavity 110 of the shoe insert liner 100 configured to receive the user's foot. Moreover, the edges of the flat pattern 122 must be folded such that the adhesive layer 102 is disposed on the exterior surface of the shoe insert liner 100. That is, the edges of the flat pattern 122 must be folded away from the adhesive layer 102. Although the flat pattern 122 is illustrated as a single piece in FIG. 6, in an alternate embodiment the flat pattern 122 may comprise two or more separate pieces which may be connected together to form the shoe insert liner 100.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "vertical," "horizontal" and similar terms have been used herein to describe a spatial relationship of one element to another, it is understood that these terms are intended to encompass different orientations of the various elements and components of the device in addition to the orientation depicted in the figures. While in one embodiment, the method of manufacturing a shoe insert liner may include each of the tasks described above and shown in FIGS. 4 and 5, respectively, in other embodiments one or more of the tasks may be absent and/or additional tasks may be performed. Moreover, the figures contained in this application are not necessarily drawn to scale.

What is claimed is:

1. A shoe insert liner configured to be received in an inner cavity of a shoe having a heel portion, a toe portion, a tongue portion, an insole portion, and opposing sidewall portions, the shoe insert liner comprising:

a plurality of layers comprising an elastomeric layer and an adhesive layer directly coupled to an exterior surface of the elastomeric layer, wherein:

the elastomeric layer having a wicking material and an antimicrobial material, the elastomeric layer comprising a longitudinal portion, opposing first and second lateral portions extending generally in an upward direction from opposite sides of the longitudinal portion, and opposing front and rear portions extending generally in the upward direction from opposite ends of the longitudinal portion, wherein, as measured from the longitudinal portion, the opposing first and second lateral portions have a first height less than a second height of the opposing front and rear portions, and wherein an interior surface of the longitudinal, lateral, front, and rear portions define an opening and a liner cavity configured to receive a user's foot, the front portion including an elastomeric toe section and an elastomeric tongue section; and the adhesive layer comprising at least a front adhesive portion and a rear adhesive portion directly coupled to the exterior surface of at least the front portion and the rear portion of the elastomeric layer, wherein the front adhesive portion is directly coupled to the elastomeric tongue section and not to the elastomeric toe section, the adhesive layer releasably coupleable to the shoe such that, when the rear adhesive portion is directly coupled to the heel portion of the shoe and the front adhesive portion is directly coupled to the tongue portion of the shoe, the opening is maintained below an upper edge of at least one of the heel portion of the shoe and the opposing sidewall portions of the shoe and, when the user's foot is received in the liner cavity, the elastomeric toe section conforms to the user's foot and stretches forward while the elastomeric tongue section provides a counter-pulling force as the user's foot is inserted into the liner cavity to expand the wicking material and the antimicrobial material of the elastomeric layer.

2. The shoe insert liner of claim 1, wherein the shoe is selected from the group of shoes consisting of loafers, boat shoes, slip on shoes, formal work shoes, oxfords, and flats.

3. The shoe insert liner of claim 1, wherein the adhesive layer has a polyurethane material.

4. The shoe insert liner of claim 1, wherein the adhesive layer has a silicone material.

5. The shoe insert liner of claim 1, wherein the adhesive layer substantially covers the entire exterior surface of the elastomeric layer other than the elastomeric toe section.

6. The shoe insert liner of claim 1, wherein the elastomeric layer comprises a continuously flat insole, and wherein the first and second lateral portions conform to the opposing sidewall portions of the shoe, the elastomeric tongue section of the front portion conforms to the tongue portion of the shoe, and the rear portion conforms to the heel portion of the shoe and is free from a projection.

7. The shoe insert liner of claim 1, wherein from approximately 5 percent to approximately 100 percent of the elastomeric layer comprises the antimicrobial material.

8. The shoe insert liner of claim 1, further comprising a removable protective sheet covering the adhesive layer.

9. The shoe insert liner of claim 1, wherein the adhesive layer includes a plurality of pores defined therethrough to provide ventilation for the user's foot.

10. The shoe insert liner of claim 1, wherein the adhesive layer is releasably coupled to the shoe with an application of positive pressure.

11. The shoe insert liner of claim 1, wherein the adhesive layer remains coupled to the shoe when the user's foot is withdrawn from the liner cavity.

12. A shoe assembly comprising:

a shoe defining an interior cavity, said shoe comprising a pair of opposing sidewalls, a heel portion, a toe portion opposite the heel portion, a tongue portion, an insole portion extending between the toe and heel portions, and a collar portion defining an opening configured to receive a user's foot; and a shoe insert liner configured to fit in the interior cavity and be releasably coupled to the shoe, the shoe insert liner comprising:

an elastomeric layer made of a wicking material and an antimicrobial material, the elastomeric layer comprising a longitudinal portion, opposing first and second lateral portions extending generally in an upward direction from opposite sides of the longitudinal portion, and opposing front and rear portions extending generally in the upward direction from opposite ends of the longitudinal portion, wherein, as measured from the longitudinal portion, the opposing first and second lateral portions have a first height less than a second height of the opposing front and rear portions, and wherein an interior surface of the longitudinal, lateral, front, and rear portions define an opening and a liner cavity configured to receive a user's foot, the front portion including an elastomeric toe section and an elastomeric tongue section; and an adhesive layer comprising at least a front adhesive portion and a rear adhesive portion directly coupled to an exterior surface of at least the front portion and the rear portion of the elastomeric layer, wherein the front adhesive portion is directly coupled to the elastomeric tongue section and not to the elastomeric toe section, the adhesive layer releasably coupleable to the shoe such that, when the rear adhesive portion is directly coupled to the heel portion of the shoe and the front adhesive portion is directly coupled to the tongue portion of the shoe, the opening is maintained below an upper edge of at least one of the heel portion of the shoe and the opposing sidewall portions of the shoe and, when the user's foot is received in the liner cavity, the elastomeric toe section conforms to the user's foot and stretches forward while the elastomeric tongue section provides a counter-pulling force as the user's foot is inserted into the liner cavity to expand the wicking material and the antimicrobial material of the elastomeric layer.

13. The shoe assembly of claim 12, wherein, when the shoe insert liner is in the interior cavity and releasably coupled to the shoe, the shoe insert liner is below the collar portion of the shoe.

14. The shoe assembly of claim 12, wherein the shoe insert liner is releasably coupled to the pair of opposing sidewalls, the heel portion, the tongue portion, and the insole portion of the shoe.

15. The shoe assembly of claim 12, wherein, when the shoe insert liner is removed from the shoe, substantially no adhesive material remains bonded to the interior cavity of the shoe or bleeds onto the interior cavity of the shoe.

16. The shoe assembly of claim 12, wherein the adhesive layer is releasably coupled to the shoe with an application of positive pressure when the user's foot is received in the liner cavity and remains coupled to the shoe when the user's foot is withdrawn from the liner cavity.

* * * * *